United States Patent [19]

Anderson et al.

[11] Patent Number: 4,958,890

[45] Date of Patent: Sep. 25, 1990

[54] REFRIGERATOR CABINET FLANGE REINFORCEMENT BAR

[75] Inventors: Vincent P. Anderson, Center Township, Vanderburgh County, Ind.; Rexford W. Cordill, Galesburg, Ill.

[73] Assignee: Whirlpool Corporation, Benton Harbor, Mich.

[21] Appl. No.: 429,792

[22] Filed: Oct. 30, 1989

[51] Int. Cl.[5] ..... A47B 81/00

[52] U.S. Cl. ..... 312/214

[58] Field of Search ..... 312/214, 236

[56] References Cited

U.S. PATENT DOCUMENTS 2,675,687 4/1954 Philipp .

4,606,112 8/1986 Jenkins et al. .

4,706,363 11/1987 Taylor, Jr. .

*Primary Examiner*—Joseph Falk

*Attorney, Agent, or Firm*—Wood, Phillips, Mason, Recktenwald & Vansanten

[57] ABSTRACT

A refrigerator cabinet includes an outer shell having a transverse flange terminating in a channel generally parallel with the flange and opening transversely inwardly. A flange reinforcement assembly includes four corner brackets spot welded rearwardly of the channel, and two reinforcement bars. An adhesive material is disposed between the reinforcement bars and the rear of the channel to adhere the same and to comprise the sole means for retaining the reinforcement bars to the cabinet.

19 Claims, 2 Drawing Sheets

FIG. 1
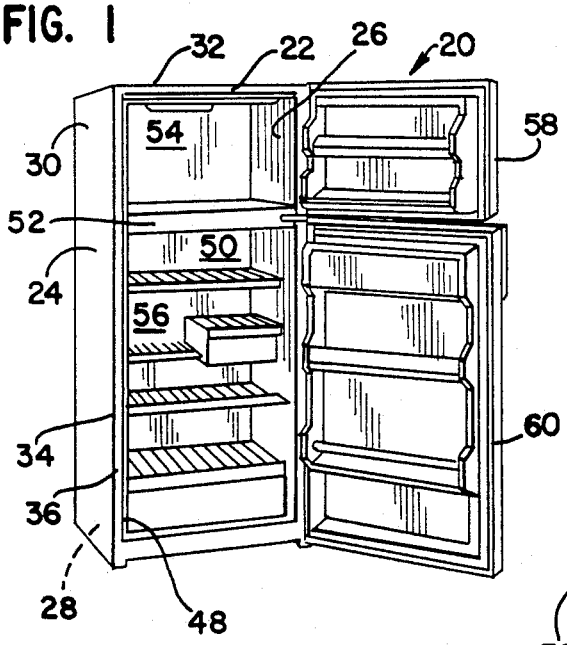
FIG. 3
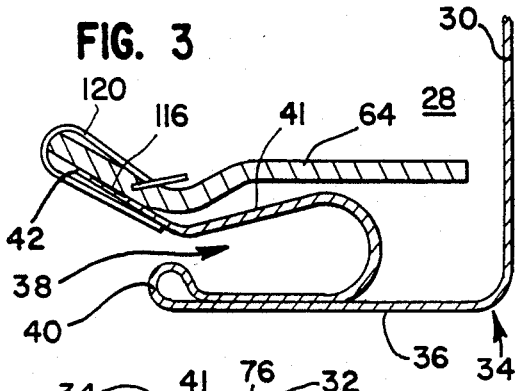
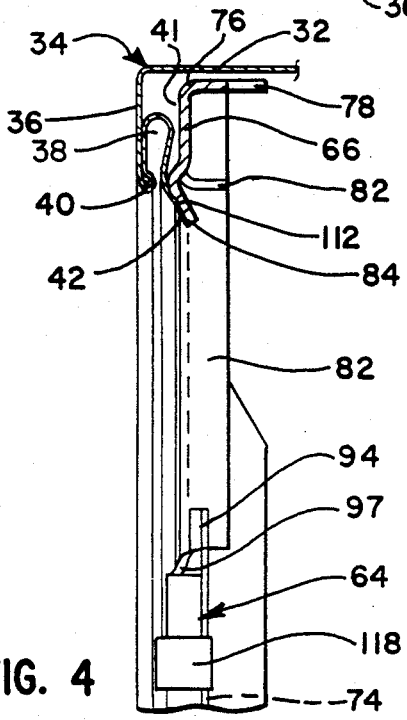
FIG. 4
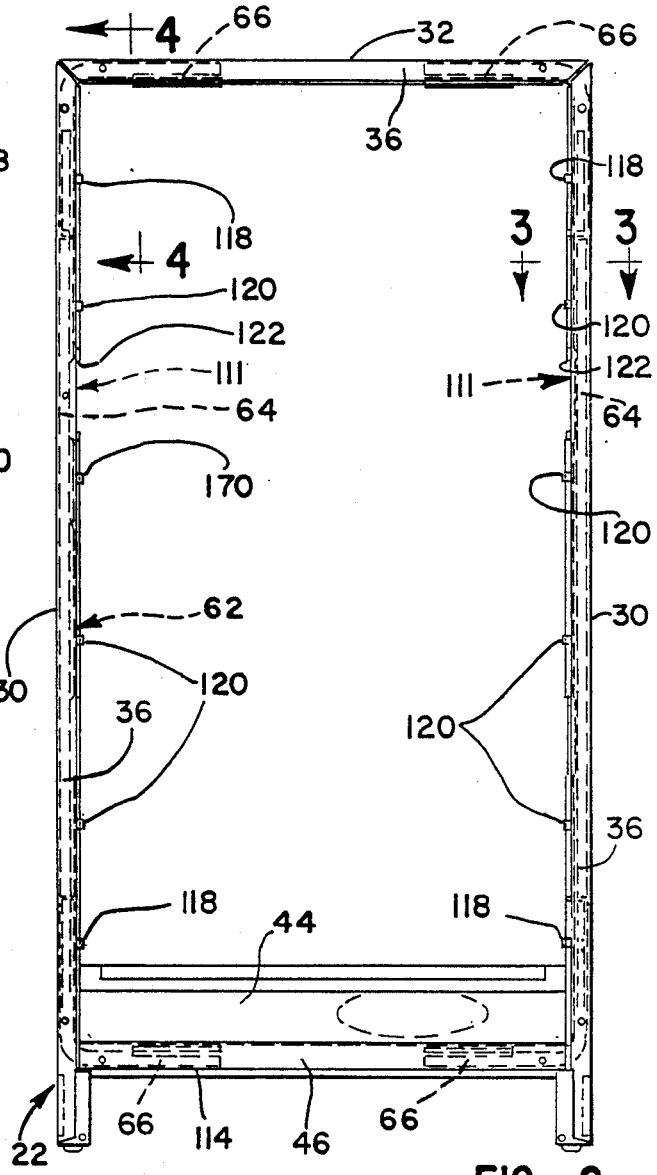
FIG. 2
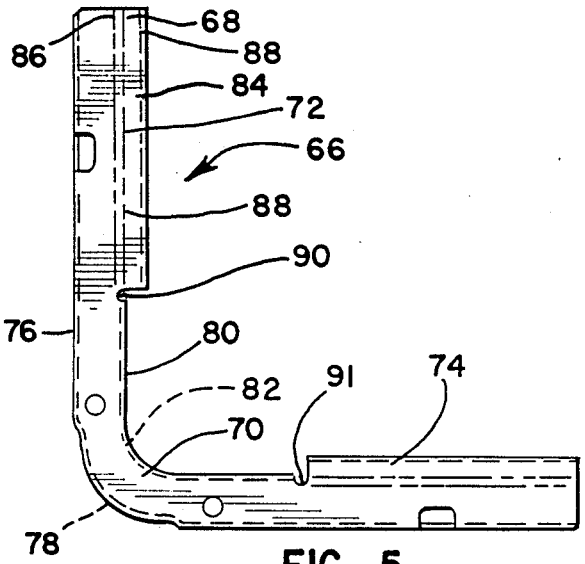
FIG. 5

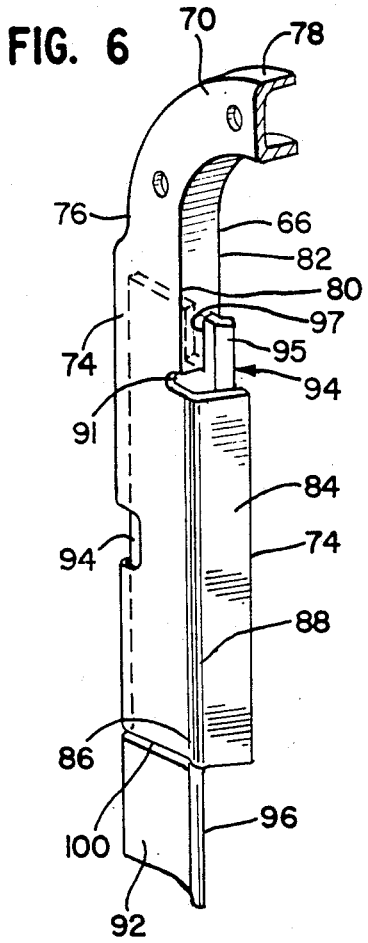
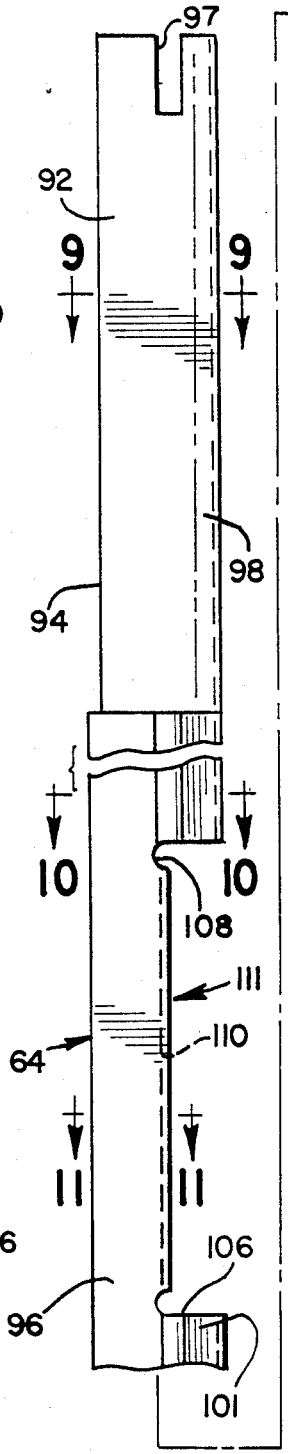
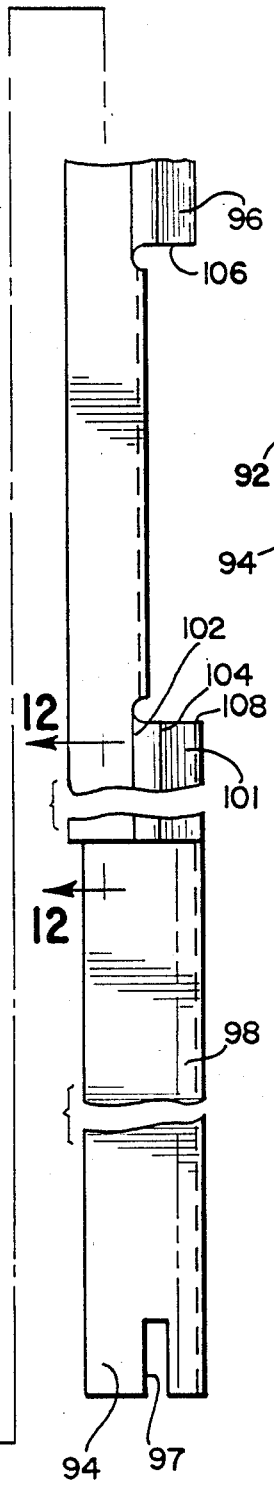
FIG. 7
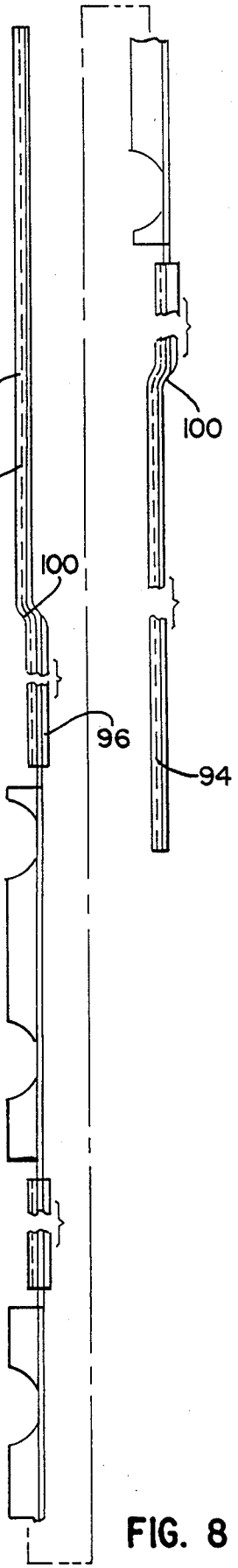
FIG. 8
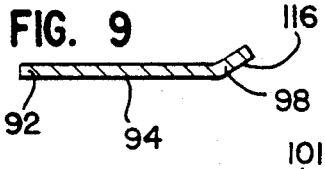
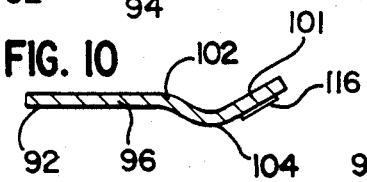
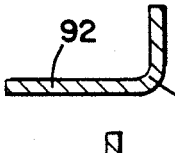
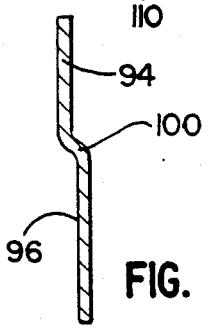

REFRIGERATOR CABINET FLANGE REINFORCEMENT BAR

FIELD OF THE INVENTION

This invention relates generally to refrigerator cabinets and, more particularly, to a flange reinforcement therefor.

BACKGROUND OF THE INVENTION

Conventional refrigerator cabinets include vertical sidewalls and horizontal insulated wall separating a freezer compartment from a fresh food compartment. The freezer compartment is provided with an upper door and the fresh food compartment is provided with a lower door. The door must span the full width of the cabinet. Therefore, the weight of the door is directly related to the cabinet width. Torsional forces produced on the cabinet by the door can cause twisting of the cabinet which may result in damage. The likelihood of such problems increases with the us of plastic liners in the refrigerator which provide less rigidity than porcelain on steel liners.

One solution to the above problem is disclosed in Jenkins et al. U.S. Pat. No. 4,632,470 which uses mounting bars mounted in the cabinet front face flange. Specifically, the mounting bars are fastened to the cabinet using screws which pass through apertures in the front flange. Such a construction results in fasteners protruding from the face of the cabinet, resulting in a less than desirable construction from an aesthetic standpoint.

The present invention overcomes the above problems of prior refrigerator cabinets, in a novel and simple manner.

SUMMARY OF THE INVENTION

In accordance with the present invention, a refrigerator cabinet is provided which uses an adhesive for securing flange reinforcement bars to the cabinet.

Broadly, there is disclosed herein a reinforcement for a refrigeration apparatus cabinet including a liner forming a space to be refrigerated, the liner having an outwardly turned edge, and an outer shell having opposite sidewalls connected to a top wall, each wall including a turned edge having a returned portion forming an inwardly opening channel receiving the turned edge of the liner. The cabinet reinforcement includes a pair of elongated flange reinforcement bars, each positioned rearwardly of the shell returned portion for one of the sidewalls, and a body of adhesive disposed between each of the reinforcement bars and its associated shell returned portion and defining the sole means for retaining the reinforcement bars in the cabinet.

In one form of the invention the adhesive comprises a urethane adhesive.

In another form of the invention the adhesive comprises a two-part epoxy adhesive.

According to one aspect of the invention the body of adhesive is disposed along the entire length of each of the reinforcement bars.

According to another aspect of the invention the bars are shaped to conform to the shell returned portion.

According to a further aspect of the invention means are provided for temporarily supporting the reinforcement bars in the cabinet prior to hardening of the adhesive.

In one form of the invention the supporting means comprises a plurality of spring clips securing the reinforcement bars to the shell returned portion.

According to another embodiment of the invention a refrigeration apparatus cabinet includes a liner forming a space to be refrigerated, an outer shell having opposite sidewalls including a yoder channel supporting the liner, and four corner brackets fastened to the shell rearwardly of the yoder channel, one at each of two opposite corners for each sidewall. A cabinet reinforcement includes a pair of elongated flange reinforcement bars. The corner brackets include keying means mateable with the reinforcement bars for positioning one each of the reinforcement bars rearwardly of the shell yoder channel between the corner brackets associated with each sidewall. A body of adhesive is disposed between each of the reinforcement bars and the shell yoder channel and defines the sole means for retaining the reinforcement bars in the cabinet.

In one aspect of the invention a plurality of spring clips are provided for fastening the reinforcement bars to the corner brackets to support the reinforcement bars while the adhesive cures.

According to a further aspect of the invention there is disclosed herein a method of manufacturing a refrigeration apparatus cabinet. Such method comprises the steps of forming a cabinet shell to include opposite sidewalls connected to a top wall and a bottom deck rail, each wall and the deck rail having an inwardly opening channel for receiving a liner; securing a corner bracket to the shell immediately rearwardly of the channel at each of four corners defined by the connection between each sidewall and the top wall and the deck rail; depositing a body of adhesive to each of a pair of elongatedflange reinforcement bars; and positioning each reinforcement bar rearwardly of the channel for each sidewall to adhere the bars thereto.

Further features and advantages of the invention will readily be apparent from the specification and from the drawings.

BRIEF DESCRIPTION OF THE DRAWINGS

FIG. 1 is perspective view of a refrigerator/freezer having a flange reinforcement embodying the invention;

FIG. 2 is an elevational view of the cabinet shell for the refrigerator/freezer of FIG. 1 illustrating the flange reinforcement embodying the invention;

FIG. 3 is a sectional view taken along the line 3—3 of FIG. 2;

FIG. 4 is a sectional view taken along the line 4—4 of FIG. 2;

FIG. 5 is an elevational view of a corner bracket;

FIG. 6 is a perspective cutaway view illustrating interconnection between the corner bracket and the flange reinforcement bar;

FIG. 7 is a front view of the flange reinforcement bar;

FIG. 8 is a side view of the flange reinforcement bar of 7;

FIG. 9 is a sectional view taken along the line 9—9 of FIG. 7;

FIG 10 is a sectional view taken along the line 10—10 of FIG. 7;

FIG. 11 is a sectional view taken along the line 11—11 of FIG. 7;

FIG 12 is a sectional view taken along the line 12—12 of FIG. 7.

DETAILED DESCRIPTION OF THE INVENTION

In the illustrated embodiment of the invention, as disclosed in the drawing, a refrigeration apparatus generally designated 20 includes a cabinet 22 having an outer metal shell 24 and an inner, synthetic resin liner 26 defining a space 28 therebetween provided with suitable insulation. The insulation may comprise foamed-in-place insulation.

Referring also to FIGS. 2–4, the outer shell 24 includes opposite, planar sidewalls 30 connected by a planar top wall 32 all turned inwardly at a front edge portion 34 to form a front flange 36. The front edge portion 34 is further double-reverse bent to form a channel 38, commonly known as a yoder channel. The channel 38 has a rounded lip 40 adjacent the front flange 36, and an inner turned wall 41 terminating at a distal edge 42. Fastened to the shell 24 in a conventional manner is a bottom deck area 44. Also, a two-piece bottom deck rail 46 is fastened to the opposite sidewalls 30. The deck rail 46 is of two-piece construction to define a channel (not shown).

The liner 26 is of conventional construction and includes walls which terminate with a transverse outwardly turned edge peripheral flange 48 generally continuous around its perimeter. The liner flange 48 is received in the outer shell yoder channel 38 and the deck rail channel during the assembly process, to provide a space 50 to be refrigerated.

An insulated divider, or separator, wall 52 extends across the space 50 to divide the same into an upper, below-freezing, freezer compartment 54, and a lower, above-freezing, fresh food compartment 56. The freezer compartment 54 is provided with an upper door 58 for selective access thereto. Similarly, the fresh food compartment 56 is provided with a lower door 60 for providing selective access thereto.

In order to increase structural stiffness of the shell 24, the cabinet 22 is provided with a flange reinforcement assembly 62. The flange reinforcement assembly 62 comprises a pair of side flange reinforcement bars 64 and four corner brackets 66.

Referring to FIG. 5, each of the four corner brackets 66 is identical in construction and therefore only one is described in detail herein. The corner bracket 66 comprises an elongate metal bar 68 turned at a 90° central elbow 70 connecting opposite legs 72 and 74. The bar 68 is turned inwardly at an outer edge portion 76 along its entire length to provide an outer wall 78. The bar elbow 70 is turned inwardly at an inner edge portion 80 to form a partial inner wall 82. The two legs 72 and 74 are identical in configuration, albeit mirror images and include inner edge portions 84 turned slightly outwardly at 86 and then downwardly at 88 and extend beyond the elbow inner edge portion 80. The leg inner edge portions 84 are shaped to conform to the yoder flange inner wall 41. A pair of opposite inner notches 90 and 91 are provided at opposite ends of the elbow inner edge portion 80 where it connects the respective legs 72 and 74.

Referring also to FIGS. 7–12, each of the two reinforcement bars 64 is identical in construction and therefore only one is illustrated.

The reinforcement bar 64 comprises an elongate, formed metal bar 92. The total length of the bar 92 is selected to be less than the height of cabinet shell 24 between the top wall 32 and the bottom rail 46, as described more specifically below. The bar 92 is symmetrical about its longitudinal centerline so that a single type reinforcement bar 64 can be used in connection with either sidewall 30. The metal bar 92 includes opposite end sections 94 connected to a middle section 96.

Each end section 94 includes a longitudinally extending end notch 97 and an inner edge portion 98 turned slightly inwardly, see FIG. 9. Each end section 94 is inwardly offset from the middle section 96 at a jog connection 100 where the metal bar 92 is double bent, see FIG. 8. The offset is provided to compensate for the thickness of the corner bracket 66.

The middle section 96 includes an inner portion 101 turned slightly outwardly at 102 and then turned back inwardly at 104, see FIG. 10, similar to the corner bracket legs 72 and 74, discussed above. Each half of the bar middle section 96 includes a pair of longitudinally spaced inner notches 106 and 108, with the inner edge portion 101 therebetween turned inwardly to provide a notch wall 110, see FIG. 11, defining a recess 111. The positioning of the recess 111 is selected to correspond to the position of the separator wall 52.

With reference again to FIGS. 2—4, a method of assembling the cabinet 22 including the flange reinforcement assembly 62 embodying the invention will no be described.

The shell 24 is formed to include the opposite sidewalls 30 and the top wall 32 including the yoder channel 38 and the deck rail 46. Each of the four corner brackets 66 is positioned immediately rearwardly of the yoder channel inner wall 41 at the four shell corners defined by the connection between the sidewalls 30 and the top wall 32 and the deck rail 46. Specifically, the corner bracket leg inner edge portions 84 are spot welded to the conforming channel inner wall 41, as at 112, see FIG. 4. For the upper corner brackets 66 one leg 72 or 74 is welded to the yoder channel inner wall 41 of its associated sidewall 30 and the other leg 74 or 72 is welded to the yoder channel inner wall 41 of the top wall 32, as is apparent. However, for the lower corner brackets 66 one leg 72 or 74 is welded to the yoder channel inner wall 41 of its associated sidewall 30 and the other leg 74 or 72 is welded to the bottom of the deck rail 46, as at 114, see FIG. 2.

Each flange reinforcement bar 64 is installed rearwardly of the side wall flanges 36. Specifically, the length of each metal bar 92 is selected so that the vertical spacing between the two notches 97 corresponds to the spacing between the corner brackets elbow notches 90 and 91 of the respective corner brackets 66 at the associated sidewall. A body of adhesive 116, see FIGS. 9 and 10, is deposited along the entire length of the bar 92 at the end section inner edge portions 98 and the middle section inner edge portion 101. The metal bar 92 is then positioned along the channel inner wall 41. The corner brackets 66 are keyed at the notches 90 and 91 to mate with the metal bar 92 as by the bar end notches 97 receiving the corner bracket elbow inner wall 82, see FIGS. 4 and 6. As a result, the adjoining corner bracket legs 74 or 72 overlaps the adjoining reinforcement bar end section 94. Owing to the jog connection 100 a continuous, relatively flush surface is provided for engaging the yoder channel inner wall 41. Consequently, the adhesive 116 is effective to secure the reinforcement bars 64 to both the corner brackets 66 and the yoder channel inner wall 41.

Referring specifically to FIG. 4, a plurality of relatively large spring clips 118 are used to temporarily retain the reinforcement bar end sections 94 in contact with the associated corner bracket leg 72 or 74 while the adhesive cures, i.e., hardens. Similarly, and referring to FIG. 3, a plurality of relatively smaller spring clips 120 are used to temporarily retain the reinforcement bar middle section 96 in contact with the yoder channel inner wall 41. A total of four large clips 118 are used, see FIG. 2, one each retaining a corner bracket 66 to its associated reinforcement bar 64. A total of eight small clips 120 are used, four for each reinforcement bar.

In the illustrated embodiment, the adhesive 116 comprises Dow Chemical Company XU16506.00 epoxy resin adhesive together with Dow Chemical Company XU16507.00 adhesive epoxy hardener. Alternatively, a suitable urethane adhesive may also be used.

As can be seen the position of the uppermost recess 111 of each reinforcement bar 64 coincides with a yoder channel notch 122 at each side for receiving the separator wall 52.

In accordance with the above, a flange reinforcement assembly 62 is provided which adds structural stiffness to the cabinet 22 with the adhesive 116 being the sole means for permanently retaining the reinforcement bars 64 in association with the yoder channel inner wall 41. As a result, no unsightly fasteners are provided through the front flange 36.

Thus, the invention broadly comprehends a cabinet structure utilizing an adhesive for securing flange reinforcement bars to the cabinet.

The foregoing disclosure of the preferred embodiments is illustrative of the broad inventive concepts comprehended by the invention.

We claim:

1. In a refrigeration apparatus cabinet including a liner forming a space to be refrigerated, said liner having an outwardly turned edge, and an outer shell having opposite sidewalls connected to a top wall, each wall including a turned front edge portion connecting a rear returned portion double reverse bent to form an inwardly opening channel receiving said turned edge of the liner, a cabinet reinforcement comprising:

a pair of elongate flange reinforcement bars each positioned rearwardly of said shell returned portion for one of said sidewalls; and a body of adhesive disposed between each of said reinforcement bars and its associated shell returned portion defining means for retaining said reinforcement bars in said cabinet.

2. The cabinet reinforcement of claim 1 wherein said body of adhesive in disposed along the entire length of each of said reinforcement bars.

3. The cabinet reinforcement of claim 1 wherein said adhesive comprises a urethane adhesive.

4. The cabinet reinforcement of claim 1 wherein said adhesive comprises a two-part epoxy adhesive.

5. The cabinet reinforcement of claim 1 wherein said bars are shaped to conform to said shell returned portion.

6. The cabinet reinforcement of claim 1 further comprising means for temporarily supporting said reinforcement bars in said cabinet prior to hardening of said adhesive.

7. The cabinet reinforcement of claim 6 wherein said supporting means comprises a plurality of spring clips securing said reinforcement bars to said shell returned portion.

8. In a refrigeration apparatus cabinet including a liner forming a space to be refrigerated, an outer shell having opposite sidewalls including a front edge portion comprising a front flange double reverse bent rearwardly to form a yoder channel supporting said liner, and four corner brackets fastened to the shell rearwardly of said yoder channel, one at each of two opposite corners for each said sidewall, an improved cabinet reinforcement comprising:

a pair of elongate flange reinforcement bars;

said corner brackets including keying means mateable with said reinforcement bars for positioning one each of said reinforcement bars rearwardly of said shell yoder channel between the corner brackets associated with each said sidewall; and a body of adhesive disposed between each of said reinforcement bars and said shell yoder channel and defining means for retaining said reinforcement bars in said cabinet.

9. The cabinet reinforcement of claim 8 wherein said body of adhesive is disposed along the entire length of each of said reinforcement bars.

10. The cabinet reinforcement of claim 8 wherein said adhesive comprises a urethane adhesive.

11. The cabinet reinforcement of claim 8 wherein said adhesive comprises a two-part epoxy adhesive.

12. The cabinet reinforcement of claim 8 wherein said bars are shaped to conform to said shell yoder channel.

13. The cabinet reinforcement of claim 8 further comprising means for temporarily supporting said reinforcement bars in said cabinet prior to hardening of said adhesive.

14. The cabinet reinforcement of claim 13 wherein said supporting means comprises a plurality of spring clips fastening said reinforcement bars to said yoder channel.

15. The cabinet reinforcement of claim 13 wherein said supporting means comprises a plurality of spring clips fastening said reinforcement bars to said corner brackets.

16. The method of manufacturing a refrigeration apparatus cabinet comprising the steps of:

forming a cabinet shell to include opposite sidewalls connected to a top wall and a bottom deck rail, each wall and said deck rail having a front flange connected to a rear, inwardly opening channel for receiving a liner;

securing a corner bracket to said shell immediately rearwardly of said channel at each of four corners defined by the connection between each sidewall and the top wall and the deck rail;

depositing a body of adhesive to each of a pair of elongate flange reinforcement bars; and positioning each reinforcement bar rearwardly of said channel, between opposite corner brackets, for each sidewall to adhere said bars thereto.

17. The method of claim 16 wherein said depositing step comprises depositing said body of adhesive along the entire length of each of said reinforcement bars.

18. The method of claim 16 further comprising the step of applying a plurality of spring clips to said reinforcement bars and said shell channel to temporarily support said reinforcement bars while said adhesive cures.

19. The method of claim 16 further comprising the step of applying a plurality of spring clips to said reinforcement bars and said corner brackets to temporarily support said reinforcement bars while said adhesive cures.

* * * * *